US006066995A

United States Patent [19]

Yagi et al.

[11] Patent Number: 6,066,995

[45] Date of Patent: May 23, 2000

[54] FOUR-PHASE PHASE CONVERTER

[75] Inventors: Yoshikazu Yagi; Yutaka Sasaki, both of Nagaokakyo; Hiroaki Tanaka, Mishima-gun, all of Japan

[73] Assignee: Murata Manufacturing Co., Ltd., Japan

[21] Appl. No.: 08/991,870

[22] Filed: Dec. 16, 1997

[30] Foreign Application Priority Data

Dec. 16, 1996 [JP] Japan ..... 8-335690
Nov. 27, 1997 [JP] Japan ..... 9-326441

[51] Int. Cl.[7] ..... H01P 1/18

[52] U.S. Cl. ..... 333/161; 333/116

[58] Field of Search ..... 333/116, 161

[56] References Cited

U.S. PATENT DOCUMENTS 3,764,941 10/1973 Nick ..... 333/116
5,446,425 8/1995 Banba ..... 333/116

*Primary Examiner*—Justin P. Bettendorf
*Attorney, Agent, or Firm*—Ostrolenk, Faber, Gerb & Soffen, LLP

[57] ABSTRACT

In four microstriplines disposed close such that they are coupled with each other, the left-hand end of the third microstripline serves as an input, the left-hand ends of the first and second microstriplines and the right-hand ends of the first and fourth microstriplines serve as outputs, and the right-hand end of the second microstripline and the left-hand end of the fourth microstripline are grounded.

8 Claims, 3 Drawing Sheets

FOUR-PHASE PHASE CONVERTER

BACKGROUND OF THE INVENTION

1. Field of the Invention

The present invention relates to four-phase phase converters, and more particularly, to a four-phase phase converter used for QPSK modulation.

2. Description of the Related Art

FIG. 6 shows a conventional four-phase phase converter. In FIG. 6, a four-phase phase converter 100 includes a signal input terminal 101, a directive coupler 102 connected to the signal input terminal, unbalanced-to-balanced converters 103 and 104 connected to two outputs of the directive coupler 102, and signal output terminals 105, 106, 107, and 108 connected to two outputs of each of the unbalanced-to-balanced converters 103 and 104. The directive coupler 102, and the unbalanced-to-balanced converters 103 and 104 are formed of a combination of $\lambda/4$ microstriplines. Since their configurations are of general types, the descriptions thereof will be omitted.

In the four-phase phase converter 100 configured as described above, a signal input to the signal input terminal 101 is converted to two signals having phases 90 degrees apart in the directive coupler 102, and they are input to the unbalanced-to-balanced converters 103 and 104. Each of the signals input to the unbalanced-to-balanced converters 103 and 104 is converted to two signals having phases 180 degrees apart and output from the signal output terminals 105, 106, 107, and 108. As a result, one signal is divided into four signals having phases 90 degrees different from each other.

In the conventional case described above, however, one directive coupler and two unbalanced-to-balanced converters, namely, three phase shifters are required to obtain one four-phase phase converter. Since this requires an area for forming eight microstriplines and certain clearances between the phase shifters in order to avoid coupling between the phase shifters, the required area is large and therefore the cost increases. In addition, an assembling cost for assembling each phase shifter is also necessary. Furthermore, since the directive coupler and the unbalanced-to-balanced converters are manufactured independently, phase deviation caused in assembling becomes large.

SUMMARY OF THE INVENTION

Accordingly, it is an object of the present invention to provide an inexpensive four-phase phase converter requiring a small area and a low manufacturing cost.

The object of the present invention is achieved in one aspect of the present invention through the provision of a four-phase phase converter including first, second, third, and fourth transmission lines sequentially disposed in parallel to couple with each other, wherein the length of the coupling sections of the first, second, third, and fourth transmission lines is set to one fourth the wavelength of the signal to be used at its frequency; and among the ends of the first, second, third, and fourth transmission lines, one end serves as a signal input end, four ends serve as signal output ends, two ends are connected to the ground, and the other one end is connected to one of the four-signal output ends.

The four-phase phase converter may be configured such that the left-hand end of the third transmission line serves as a signal input end; the left-hand ends of the first and second transmission lines and the right-hand ends of the first and fourth transmission lines serve as signal output ends; the right-hand end of the second transmission line and the left-hand end of the fourth transmission line are grounded; and the right-hand end of the third transmission line is connected to the right-hand end of the first transmission line.

The four-phase phase converter may also be configured such that the left-hand end of the second transmission line serves as a signal input end; the left-hand ends of the third and fourth transmission lines and the right-hand ends of the first and second transmission lines serve as signal output ends; the left-hand end of the first transmission line and the right-hand end of the fourth transmission line are grounded; and the right-hand end of the third transmission line is connected to the right-hand end of the second transmission line.

The object of the present invention is achieved in another aspect of the present invention through the provision of a four-phase phase converter including first, second, third, and fourth transmission lines sequentially disposed in parallel in the horizontal direction to couple with each other; wherein the length of the coupling sections of the first, second, third, and fourth transmission lines is set to one fourth the wavelength of the signal to be used at its frequency; and among the ends of the first, second, third, and fourth transmission lines, one end serves as a signal input end, four ends serve as signal output ends, one end is connected to the ground, and the other two ends are connected to two of the four signal output ends.

The four-phase phase converter may be configured such that the left-hand end of the first transmission line serves as a signal input end; the left-hand ends of the second and fourth transmission lines and the right-hand ends of the first and second transmission lines serve as signal output ends; the right-hand end of the third transmission line is grounded; and the left-hand end of the third transmission line is connected to the left-hand end of the second transmission line, and the right-hand end of the fourth transmission line is connected to the right-hand end of the first transmission line.

According to a four-phase phase converter of the present invention, since four $\lambda/4$ transmission lines are arranged such that they are coupled with each other, and among the eight ends thereof, one end is used as an input end, four ends are used as output ends, and the other ends are grounded or connected to an output end, an inexpensive four-phase phase converter requiring a small area and a small phase variation is obtained.

DESCRIPTION OF THE PREFERRED EMBODIMENTS

Figure 1:
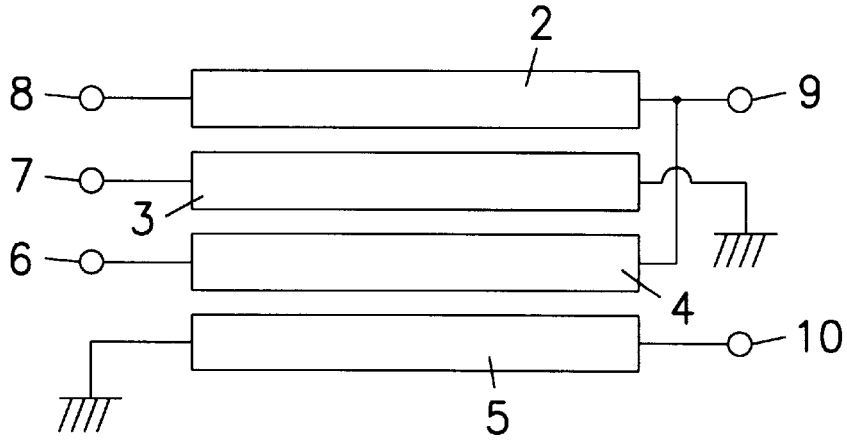
FIG. 1 shows a four-phase phase converter according to an embodiment of the present invention.

FIG. 1 shows a four-phase phase converter according to an embodiment of the present invention. In FIG. 1, a four-phase phase converter 1 includes microstriplines 2, 3, 4, and 5 serving as first, second, third, and fourth transmission lines disposed close such that they are coupled with each other, a signal input terminal 6, and signal output terminals 7, 8, 9, and 10.

The signal input terminal 6 is connected to the left-hand end of the third microstripline 4 serving as a signal input end, the signal output terminal 7 is connected to the left-hand end of the second microstripline 3 serving as a first signal output end, the signal output terminal 8 is connected to the left-hand end of the first microstripline 2 serving as a second signal output end, the signal output terminal 9 is connected to the right-hand end of the first microstripline 2 serving as a third signal output end, and the signal output terminal 10 is connected to the right-hand end of the fourth microstripline 5 serving as a fourth signal output end. The right-hand ends of the first and third microstriplines 2 and 4 are connected to each other, and the right-hand end of the second microstripline 3 and the left-hand end of the fourth microstripline 5 are grounded.

The microstriplines 2, 3, 4, and 5 are set such that their length equals one fourth the wavelength of the signal to be used at its frequency.

In the four-phase phase converter 1 configured as described above, when a signal is input to the signal input terminal 6, signals having phases 90 degrees apart from each other are output from the signal output terminals 7, 8, 9, and 10.

Figure 2:
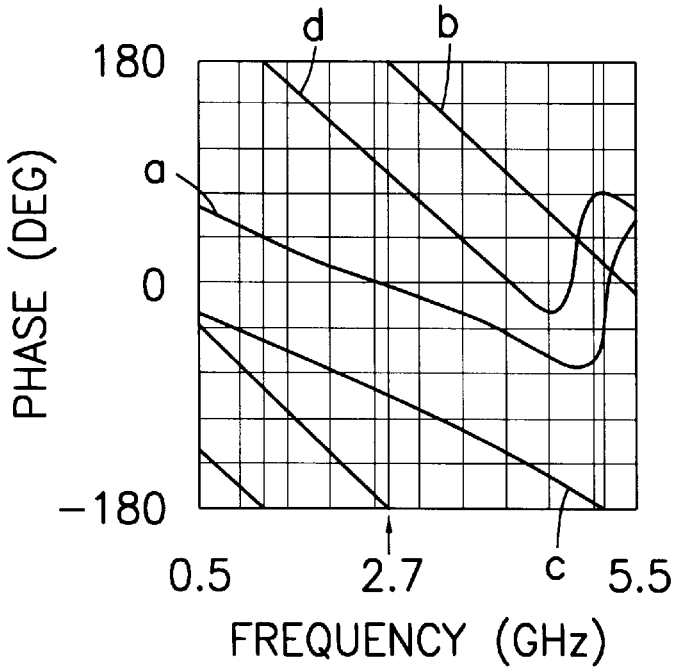
FIG. 2 shows a phase characteristic of the four-phase phase converter shown in FIG. 1.

FIG. 2 is a graph indicating a phase characteristic of the four-phase phase converter 1 shown in FIG. 1. In FIG. 2, the horizontal axis indicates a frequency and the vertical axis indicates the phase shift of an output signal from the phase of the corresponding input signal. In FIG. 2, curve "a" indicates the phase shift of an signal output from the signal output terminal 7 from the phase of the corresponding input signal, curve "b" indicates the phase shift of a signal output from the signal output terminal 8, curve "c" indicates the phase shift of a signal output from the signal output terminal 9, and curve "d" indicates the phase shift of a signal output from the output signal terminal 10. The phases of the four outputs are different from each other by 90 degrees at 2.7 GHz, which is the frequency of the used signal, as shown in FIG. 2.

Figure 3:
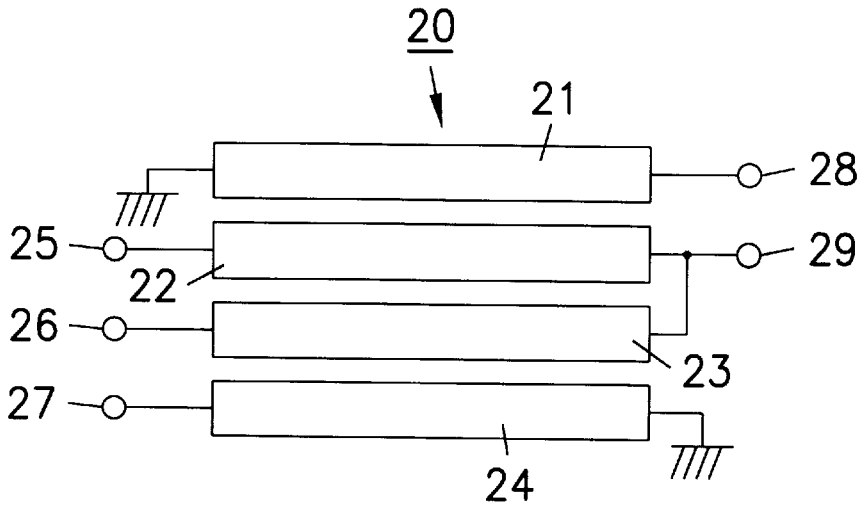
FIG. 3 shows a four-phase phase converter according to another embodiment of the present invention.

FIG. 3 shows a four-phase phase converter according to another embodiment of the present invention. In FIG. 3, a four-phase phase converter 20 includes microstriplines 21, 22, 23, and 24 serving as first, second, third, and fourth transmission lines disposed close such that they are coupled with each other, a signal input terminal 25, and signal output terminals 26, 27, 28, and 29.

The signal input terminal 25 is connected to the left-hand end of the second microstripline 22 serving as a signal input end, the signal output terminal 26 is connected to the left-hand end of the third microstripline 23 serving as a first signal output end, the signal output terminal 27 is connected to the left-hand end of the fourth microstripline 24 serving as a second signal output end, the signal output terminal 28 is connected to the right-hand end of the first microstripline 21 serving as a third signal output end, and the signal output terminal 29 is connected to the right-hand end of the second microstripline 22 serving as a fourth signal output end. The right-hand ends of the second and third microstriplines 22 and 23 are connected to each other, and the left-hand end of the first microstripline 21 and the right-hand end of the fourth microstripline 24 are grounded.

The microstriplines 21, 22, 23, and 24 are set such that their length equals one fourth the wavelength of the signal to be used at its frequency.

In the four-phase phase converter 20 configured as described above, when a signal is input to the signal input terminal 25, signals having phases 90 degrees apart from each other are output from the signal output terminals 26, 27, 28, and 29.

Figure 4:
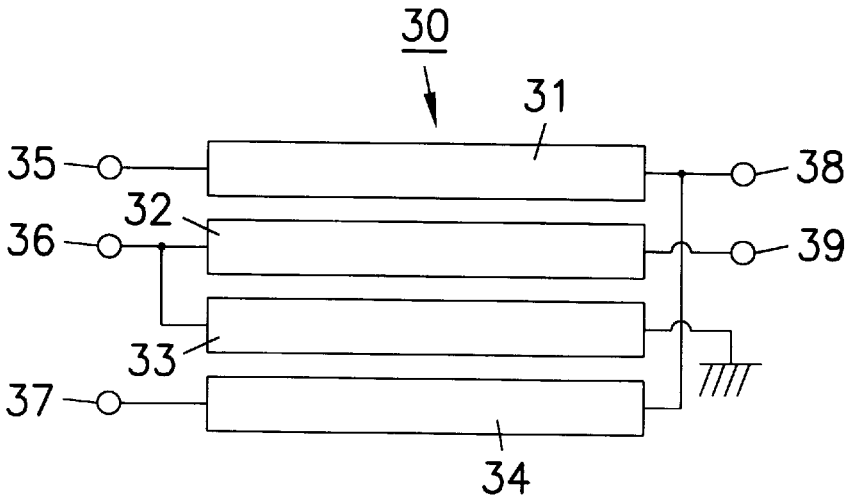
FIG. 4 shows a four-phase phase converter according to still another embodiment of the present invention.

FIG. 4 shows a four-phase phase converter according to still another embodiment of the present invention. In FIG. 4, a four-phase phase converter 30 includes-microstriplines 31, 32, 33, and 34 serving as first, second, third, and fourth transmission lines disposed close such that they are coupled with each other, a signal input terminal 35, and signal output terminals 36, 37, 38, and 39.

The signal input terminal 35 is connected to the left-hand end of the first microstripline 31 serving as a signal input end, the signal output terminal 36 is connected to the left-hand end of the second microstripline 32 serving as a first signal output end, the signal output terminal 37 is connected to the left-hand end of the fourth microstripline 34 serving as a second signal output end, the signal output terminal 38 is connected to the right-hand end of the first microstripline 31 serving as a third signal output end, and the signal output terminal 39 is connected to the right-hand end of the second microstripline 32 serving as a fourth signal output end. The left-hand ends of the second and third microstriplines 32 and 33 are connected to each other, the right-hand ends of the first and fourth microstriplines 31 and 34 are connected to each other, and the right-hand end of the third microstripline 33 is grounded.

The microstriplines 31, 32, 33, and 34 are set such that their length equals one fourth the wavelength of the signal to be used at its frequency.

In the four-phase phase converter 30 configured as described above, when a signal is input to the signal input terminal 35, signals having phases 90 degrees apart from each other are output from the signal output terminals 36, 37, 38, and 39.

Figure 5:
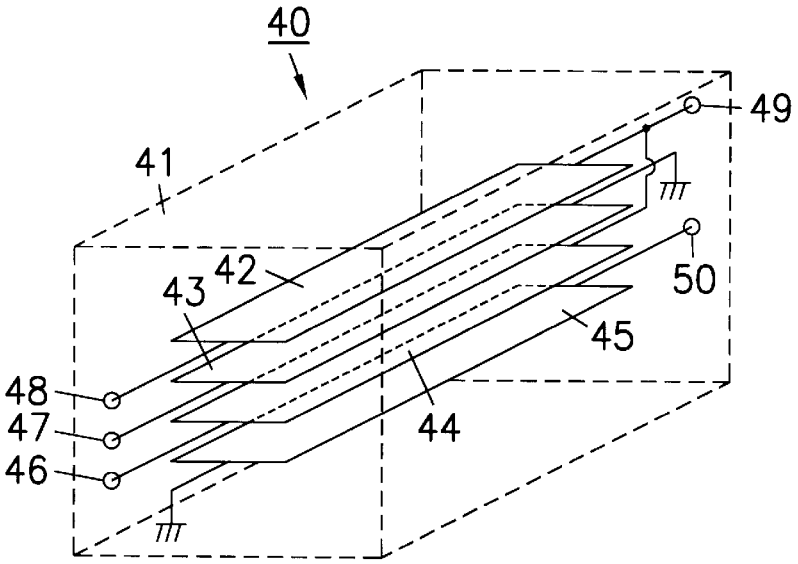
FIG. 5 is a perspective view of a four-phase phase converter according to yet another embodiment of the present invention.
Figure 6:
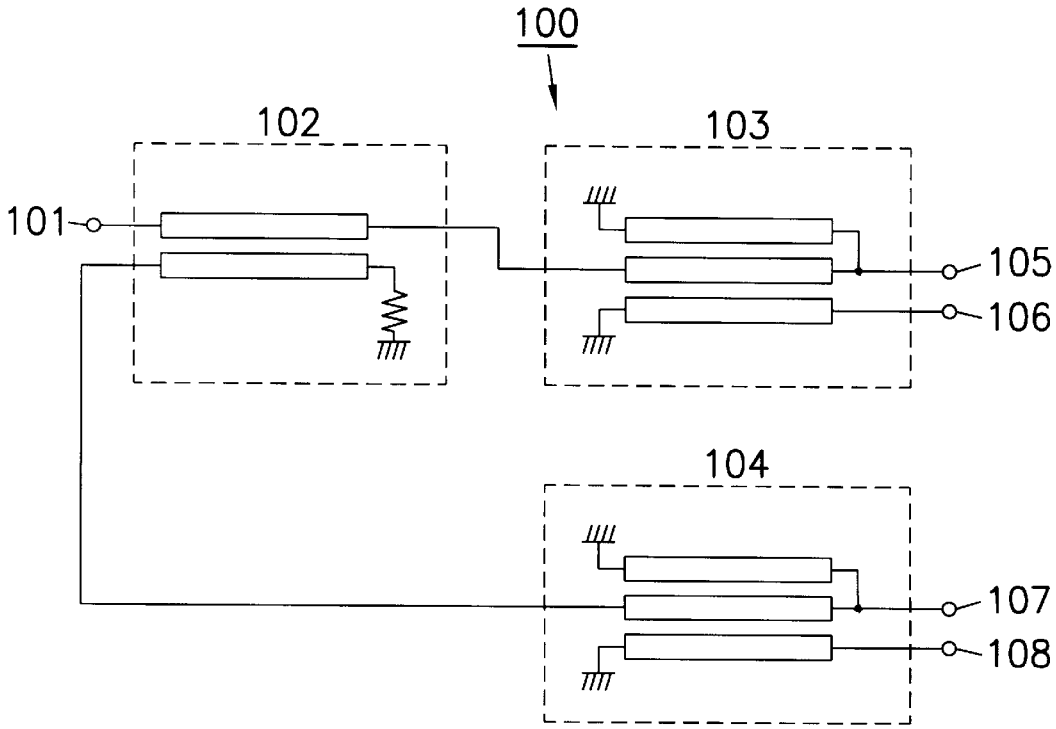
FIG. 6 Prior Art
FIG. 6 shows a conventional four-phase phase converter.

FIG. 5 shows a four-phase phase converter according to yet another embodiment of the present invention. In FIG. 5, a four-phase phase converter 40 includes strip conductors 42, 43, 44, and 45 serving as first, second, third, and fourth transmission lines laminated with a dielectric 41 sandwiched therebetween to form a multilayer structure and disposed with appropriate gaps therebetween such that they are coupled with each other, a signal input terminal 46, and signal output terminals 47, 48, 49, and 50.

The signal input terminal 46 is connected to the left-hand end of the third strip conductor 44 serving as a signal input end, the signal output terminal 47 is connected to the left-hand end of the second strip conductor 43 serving as a first signal output end, the signal output terminal 48 is connected to the left-hand end of the first strip conductor 42 serving as a second signal output end, the signal output terminal 49 is connected to the right-hand end of the first strip conductor 42 serving as a third signal output end, and the signal output terminal 50 is connected to the right-hand end of the fourth strip conductor 45 serving as a fourth signal output end. The right-hand ends of the first and third strip conductors 42 and 44 are connected to each other, and the right-hand end of the second strip conductor 43 and the left-hand end of the fourth strip conductor 45 are grounded.

The strip conductors 42, 43, 44, and 45 are set such that their length equals one fourth the wavelength of the signal to be used at its frequency.

The input and output terminals and ground connection of each transmission line in the four-phase phase converter 40 are the same as those in the four-phase phase converter 1 shown in FIG. 1.

In the four-phase phase converter 40 configured as described above, when a signal is input to the signal input terminal 46, signals having phases 90 degrees apart from each other are output from the signal output terminals 47, 48, 49, and 50.

In the present invention, as shown in each of the above embodiments, among the eight ends of four transmission lines sequentially disposed in parallel to couple with each other, one end is used as an input end, four ends are used as output ends, and the other ends are grounded or connected to either of the output ends to form a four-phase phase converter. With this configuration, an area required for the four-phase phase converter is made smaller and the cost thereof is made more inexpensive. In addition, since a plurality of phase shifters do not need to be combined, phase variation becomes small.

In the above embodiments, straight microstriplines and strip conductors are used as transmission lines. They may be formed in a curved shape such as a meander-shape or a spiral shape with the positional relationship between the four transmission lines being maintained. In the above embodiments, microstriplines and strip conductors are used. Other transmission lines such as strip lines and electrically conductive cables may be used, and the same advantages are obtained in that case.

What is claimed is:

1. A four-phase converter comprising first, second, third, and fourth transmission lines, each having two ends, sequentially disposed in parallel to couple with each other at coupling sections thereof, wherein the length of the coupling sections of said first, second, third, and fourth transmission lines is set to one fourth the wavelength of the signal to be used; and among the eight ends of said first, second, third, and fourth transmission lines, one end serves as a signal input end, four ends are connected to respective output terminals and serve as signal output ends, two ends are connected to ground, and one end is connected to one of the four signal output ends, the other three signal output ends being connected only to said respective output terminals.

2. A four-phase converter according to claim 1, wherein said two ends are connected directly to ground.

3. A four-phase converter comprising first, second, third, and fourth transmission lines, each having two ends, sequentially disposed in parallel to couple with each other at coupling sections thereof, wherein the length of the coupling sections of said first, second, third, and fourth transmission lines is set to one fourth the wavelength of the signal to be used;

among the eight ends of said first, second, third, and fourth transmission lines, one end serves as a signal input end, four ends serve as signal output ends, two ends are connected to ground, and one end is connected to one of the four signal output ends;

a first end of said third transmission line serves as the signal input end;

first ends of said first and second transmission lines and second ends of said first and fourth transmission lines serve as the signal output ends;

the second end of said second transmission line and the first end of said fourth transmission line are grounded; and the second end of said third transmission line is connected to the second end of said first transmission line.

4. A four-phase converter according to claim 3, wherein said two ends are connected directly to ground.

5. A four-phase converter comprising first, second, third, and fourth transmission lines, each having two ends, sequentially disposed in parallel to couple with each other at coupling sections thereof, wherein the length of the coupling sections of said first, second, third, and fourth transmission lines is set to one fourth the wavelength of the signal to be used at its frequency;

among the eight ends of said first, second, third, and fourth transmission lines, one end serves as a signal input end, four ends serve as signal output ends, two ends are connected to ground, and one end is connected to one of the four signal output ends;

a first end of said second transmission line serves as the signal input end;

first ends of said third and fourth transmission lines and second ends of said first and second transmission lines serve as signal output ends;

a first end of said first transmission line and a second end of said fourth transmission line are grounded; and a second end of said third transmission line is connected to the second end of said second transmission line.

6. A four-phase converter according to claim 5, wherein said two ends are connected directly to ground.

7. A four-phase phase converter comprising first, second, third, and fourth transmission lines, each having two ends, sequentially disposed in parallel in a horizontal direction to couple with each other at coupling sections thereof;

wherein the length of the coupling sections of said first, second, third, and fourth transmission lines is set to one fourth the wavelength of the signal to be used at its frequency; and among the eight ends of said first, second, third, and fourth transmission lines, one end serves as a signal input end, four ends serve as signal output ends, one end is connected to ground, and two ends are connected to two of the four signal output ends.

8. A four-phase phase converter according to claim 7, wherein a first end of said first transmission line serves as the signal input end;

first ends of said second and fourth transmission lines and second ends of said first and second transmission lines serve as the signal output ends;

a second end of said third transmission line is grounded; and a first end of said third transmission line is connected to the first end of said second transmission line, and a second end of said fourth transmission line is connected to the second end of said first transmission line.

* * * * *